United States Patent [19]

Duke et al.

[11] 4,171,185

[45] Oct. 16, 1979

[54] SONIC PUMP OFF DETECTOR

[75] Inventors: Billy J. Duke; William H. Meister, both of Odessa, Tex.

[73] Assignee: Operational Devices, Inc., Odessa, Tex.

[21] Appl. No.: 916,865

[22] Filed: Jun. 19, 1978

[51] Int. Cl.[2] ..... F04B 49/00

[52] U.S. Cl. ..... 417/12; 417/36

[58] Field of Search ..... 417/12, 36

[56] References Cited

U.S. PATENT DOCUMENTS

| | | | |
|---|---|---|---|
| 3,091,179 | 5/1963 | Eikols | 417/12 |
| 3,918,843 | 11/1975 | Douglas et al. | 417/12 |
| 3,938,910 | 2/1976 | Douglas | 417/12 |
| 4,121,094 | 10/1978 | Diuito | 417/36 |

*Primary Examiner*—William L. Freeh

*Attorney, Agent, or Firm*—Wendell Coffee

[57] ABSTRACT

Pump off conditions of an oil well are determined by listening to the sonic clicks of the traveling valve and bottom hole valve. If the clicks do not occur within a certain period after top dead center for successive pump cycles, the well is assumed to be pumped off and is shut down. If, upon being restarted for a successive number of times, the valves do not click within the proper time frame it is assumed that there has been a pump failure and the well is shut down until manually restarted.

11 Claims, 1 Drawing Figure

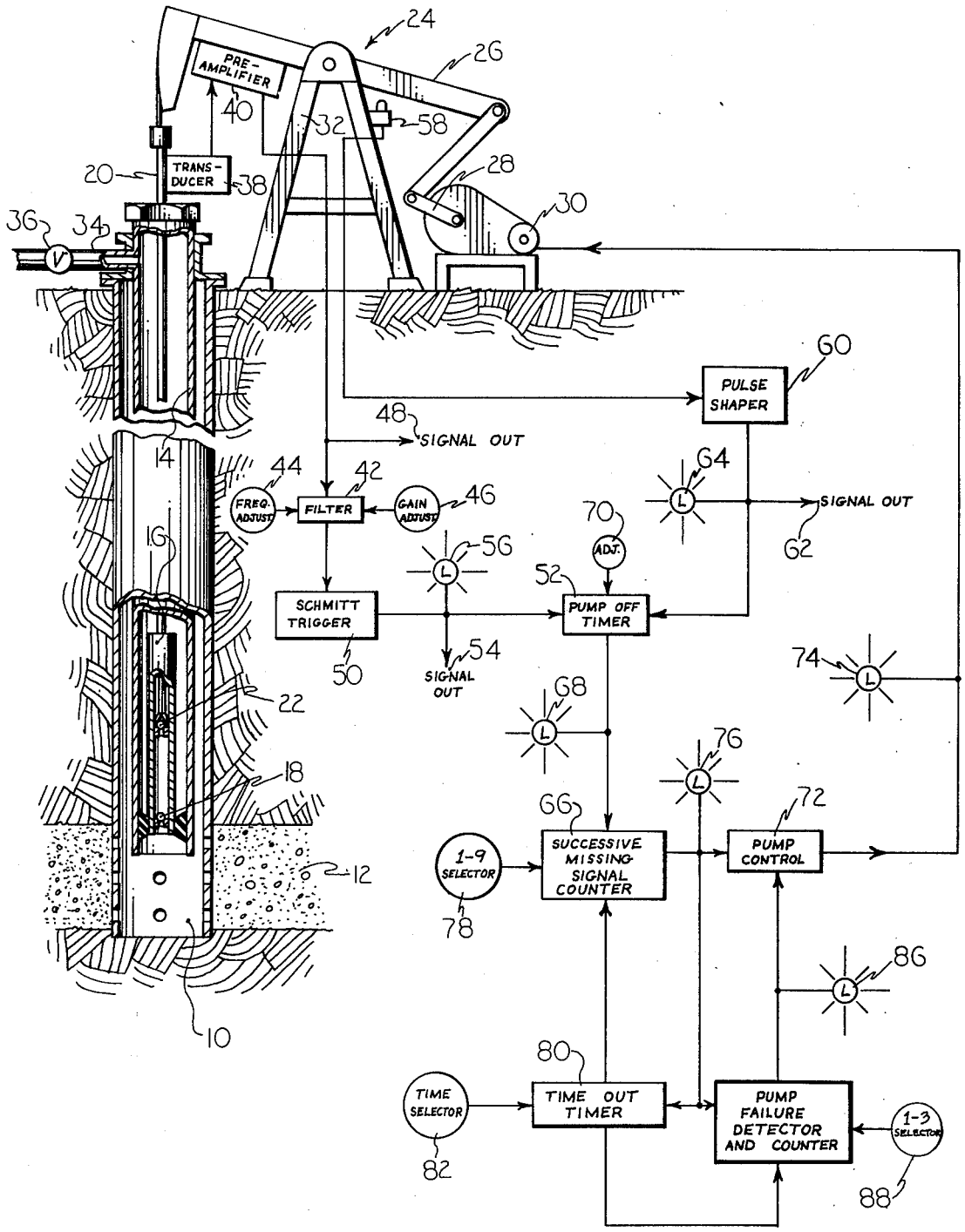
PRE-AMPLIFIER
TRANS-DUCER
PULSE SHAPER
SIGNAL OUT
FREQ. ADJUST
FILTER
GAIN ADJUST
SCHMITT TRIGGER
ADJ.
PUMP OFF TIMER
SIGNAL OUT
SIGNAL OUT
1-9 SELECTOR
SUCCESSIVE MISSING SIGNAL COUNTER
PUMP CONTROL
TIME SELECTOR
TIME OUT TIMER
PUMP FAILURE DETECTOR AND COUNTER
1-3 SELECTOR

SONIC PUMP OFF DETECTOR

CROSS REFERENCE TO RELATED APPLICATIONS

None. However, applicant filed Disclosure Document No. 065043 on Oct. 14, 1977, which document concerns this application; therefore, by separate letter, it is respectfully requested that the document be retained and acknowledgement thereof made by the Examiner.

BACKGROUND OF THE INVENTION (1) Field of the Invention

This invention relates to producing oil wells and more particularly to a time measurement and counting means.

(2) Description of the Prior Art

Pump off condition exists in an oil well when the amount of liquid in the bottom of the well is insufficient to properly load the reciprocating pump for each stroke. It is a well recognized problem and many solutions have been sought for it. E.g., SMITH, U.S. Pat. No. 2,550,093 discloses a system wherein the well fluids are pumped against a spring loaded check valve which is above ground.

COTTRELL, U.S. Pat. No. 3,274,940, discloses a system where the fluid from the pump is pumped into a chamber which has a float operated switch therein.

URMANN et al., U.S. Pat. No. 2,690,713, discloses a system where the level of the liquid in the well is determined which is used to initiate a signal to control the pump operation.

AGNEW et al., U.S. Pat. No. 3,075,466, discloses a system where the variation of the currents drawn by the pump motor is used to control.

DOUGLAS, U.S. Pat. No. 3,854,846, discloses a system where pressure pulses are used in a control system. This patent also discloses the specific electrical circuit necessary for permanently shutting down a pumping system until it is manually restarted, if several restarts fail to cause the flow high enough to actuate a reset signal.

Before filing this application the inventors caused a search in the U.S. Patent and Trademark Office to be made which disclosed the following patents:

Tilley et al.—U.S. Pat. No. 3,269,320
Skinner, II et al.—U.S. Pat. No. 3,665,960
Mills—U.S. Pat. No. 3,851,995
Watson—U.S. Pat. No. 3,965,983

TILLEY et al. discloses equipment wherein sonic means is used to determine the pounding which occurs at pump off. After a predetermined cumulative duration of the pounding the well is shut off.

WATSON discloses a system for using the timing of sound waves to determine the level of the liquid within the well.

The other patents discovered on the search do not seem to be as pertinent as those specifically discussed above.

SUMMARY OF THE INVENTION (1) New and Different Function

We have discovered that the most useful information to base pump off is by listening to the valve clicks and determining when in the cycle they occur. Twice during each pumping cycle the traveling valve and bottom hole valve will operate to produce a sonic click.

After the sucker rod has reached top dead center the traveling valve will open and make an audible click as it reaches the top of the valve cage, while the bottom hole valve will close and make an audible click as it seats. After bottom dead center, the bottom hole valve will open and make an audible click as it hits the top of its cage and the traveling valve will close and make an audible click as it is seated.

We prefer to work with the first described clicks, i.e., the clicks that occur after top dead center, which is to say, the clicks which occur during the down stroke of the sucker rod. Those skilled in the oil field pumping arts will understand that the down stroke of the pump does not necessarily occur simultaneously with the down stroke of the pump jack. The pumps are often located far below the surface of the earth and due to the elasticity of the sucker rod, the movement of the pump at the bottom of the sucker rod and the pump jack at the top are not always simultaneous. Also, those familiar with producing oil wells will understand that skilled people with long experience with pumping oil wells can make certain evaluation of the condition of the pump and of the well from listening to the valves click.

We have determined that if the click is not detected within a certain time period after the beginning of the down stroke that the well is not functioning properly. Of course, any time the well is not functioning properly the first assumption is that it is pumped off and needs to be shut down for a predetermined period of time. Those skilled in the art and also those having studied the prior patents listed above will understand not necessarily any two wells will operate the same. I.e., some need to be shut down for a longer period of time than others. However, after they have been shut down their standard period of time and restarted, if they do not again begin operation there is a strong likelihood that a pump failure has occurred rather than the well merely being pumped off. (See DOUGLAS above.)

We find good, reliable equipment can be inexpensively built based upon the timing in which either the clicks are received or the clicks are not received.

Thus it may be seen that the entire function of the combined equipment is far greater than the total of the functions of the individual transducers, timers, counters, etc.

(2) Objects of This Invention

An object of this invention is to control a well as to pump off and pump failure.

Further objects are to achieve the above with a device that is sturdy, compact, durable lightweight, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not scale drawings.

BRIEF DESCRIPTION OF THE DRAWING

The drawing shows a schematic representation of a producing oil well with a schematic representation of an embodiment of our invention connected thereto.

DESCRIPTION OF THE PREFERRED EMBODIMENT

Referring to the drawing there may be seen schematically represented an oil well. Traditionally the well will have casing 10 extending from the surface of the earth to far below the surface into oil producing strata 12. As seen the casing is perforated within the strata to permit fluid and particularly liquid oil to enter the space within the casing.

Tubing 14 extends within the casing to near the bottom thereof. Pump 16 is located within the tubing and is fluidly sealed to the tubing by a packer at the bottom thereof. Bottom hole valve 18 is at the bottom of the pump. Sucker rod 20 extends from above the surface of the ground to traveling valve 22 within the pump 16. Pump jack 24 located above the surface of the ground includes walking beam 26 actuated by crank 28 driven by electric motor 30. The walking beam is supported by Sampson post 32, and cyclically reciprocates the rod 20.

The top of the tubing 14 is connected to production pipe 34 which has production valve 36 adjacent to the well head.

Those skilled in the art will understand the equipment described to this point is well known and common in the oil field and that upon the down stroke of the sucker rod 20, the traveling valve 22 will open and produce a click upon the cage as it opens while the bottom hole valve will close producing a click as it closes. Likewise, on the up stroke, the traveling valve 22 will close with an audible click while the bottom hole valve 18 will open with an audible click.

According to our invention, transducer 38 is attached to the well above the surface thereof. We prefer to attach transducer 38 to the top of the sucker rod (commonly called the polish rod). The sucker rod reciprocates up and down and, therefore, it is necessary to conduct the wiring from the transducer to the walking beam and to the Sampson post in order to transmit the signal to the controls. However, we prefer to attach the transducer to the sucker rod because even with the difficulties of physically attaching the wiring to these moving parts, we believe we achieve superior results. However, those with ordinary skill will understand that the transducer could be attached either to the top of the tubing 14 or to the top of the casing 10 or to the production pipe 34 or even the production valve 36. Indeed, Tilley et al. (discussed above) attaches his listening device to a portion of the Sampson post.

The signal from the transducer is amplified by preamplifier 40 located with or adjacent to the transducer. The preamplifier will have a gain of about 40 times. One of the main functions of the preamplifier is to match the impedence of the transducer to filter 42. It will be understood that the preamplifier 40 could also be mounted on the sucker rod 20 itself. However, as illustrated, the preamplifier is located on a portion of the walking beam 26.

The signal from the preamplifier is connected to the filter 42. The purpose of the filter is to filter out all other sounds picked up by the transducer and amplified by the preamplifier except for the valve clicks. The valve clicks from each well will have a particular frequency. Therefore, we prefer to use a high Q filter having a Q value of 25 and above. We prefer using a filter having a Q value of about 50. We have found that most of the valve clicks have a frequency of about 900 hertz. We adjust the frequency response to the filter 42 by frequency adjustment 44 so that it can be made responsive to any particular frequency from 500 to 1500 hertz. The filter 42 will also amplify the signal and we prefer to amplify it about $2\times10^5$ times. We prefer to have the gain adjustable and, therefore, provide an amplification adjustment or gain adjustment 46 for that purpose. The signal received by the filter will be amplified within a range of about $5\times10^4$ to $1\times10^6$.

Experienced personnel can determine the condition of the well from listening to the valve clicks. For this reason, the signal, before it is filtered and amplified by the filter, can be analyzed by the use of phone jack 48. The signal from the phone jack 48 may be analyzed by placing the signal upon head phones or a loudspeaker or the signal may be visually produced on an oscillascope or permanently recorded upon a recorder.

After the signal from the transducer 38 has been filtered and amplified by the filter 42 it is fed to Schmitt trigger 50. The Schmitt trigger will produce a uniform electrical pulse from the sonic clicks. Thus are provided means for producing an electrical click signal from the sonic valve clicks. The output of the Schmitt trigger is fed to pump off timer 52. There is likewise an output jack 54 so this signal can be analyzed and also there is an indicator lamp 56 to indicate if there is a series of pulses being produced at this point.

The cycle positioner is determined by cycle switch 58 which is located on the Sampson post 32 adjacent to the walking beam 26. It will produce a signal when the pump jack 24 is at the top dead center or close thereto. This signal is shaped by pulse shaper 60. The output of the pulse shaper 60 is also fed to the pump off timer 52. Likewise an output jack 62 and an indicator lamp 64 is provided so that there is a visual indication that this circuit is operating properly. Pump off timer 52 produces a time gate from the cyclical signal received from the pulse shaper 60. I.e., a certain time period is produced by the pump off timer beginning with each pulse for cyclical signal received. Those skilled in the art will understand that the pump jack will cyclically reciprocate at various speeds perhaps as slow as 3 strokes a minute or as fast as 30 strokes a minute but most operate at about 10 or 12 strokes a minute. E.g., the pump jack is cyclically reciprocating the sucker rod every 5 seconds, the gate that is produced by the pump off timer 52 might be a 1 second gate, i.e., it would establish a time period of 1 second after the cycle switch 58 had indicated that the pump jack was at top dead center.

If a signal was received from the Schmitt trigger within this gate the pump off timer would be reset and there would be no signal output from the pump off timer. However, if a click signal is not received within the time gate, a missing signal pulse will be produced and transmitted to successive missing signal counter 66. Production of this signal will produce a flash upon indicator lamp 68. As stated before, no two wells are identical and also different operators may desire to make different adjustments before shutting the well down for pump off. Therefore, timing adjustment 70 upon the pump off timer 52 is provided so that the length of the time gate can be adjusted.

The pump off timer 52 will produce signals to the signal counter 66 when a click signal is not received within the time gate. The counter 66 counts successive signals. E.g. if 3 signals in succession are not received, it may be assumed that the pump has pumped off and, therefore, a pump off signal is transmitted to pump controller 72 that the well has pumped off thereby shutting down the pump jack by disconnecting the power supply to the electric motor 30. If two signals are missed and one is received the counter will begin again.

Indicator lamp 74 indicates shut down has occurred. Indicator lamp 76 indicates that such a signal has been given by the signal counter 66 to pump controller 72. Obviously, some operators, because of the individual operation of some wells, may desire that a pump off signal might be given for some number of successive signals other than 3, therefore, selector 78 provides that the signal may be given after a predetermined number of successive missing signals have been received by the signal counter 66. This adjustment may be anywhere from 1 to 9 missing signals.

At the time a pump off signal is given from signal counter 66 to pump controller 72, time out timer 80 is begun running. The time the well is shut off or pumped off can be selected by time selector 82. As soon as the selected time, e.g., six hours has elapsed, the time out timer produces a signal to the pump controller that it can reconnect the power to the electric motor 30, again beginning operation.

Immediately after the pump controller 72 begins operation, if pump failure detector and counter 84 receives a missing signal count from signal counter 66, it will itself operate the pump controller 72 to shut down the pump. Indicator lamp 86 indicates that such has occurred. The number of missing signals necessary to actuate the pump failure detector 84 may be different from the number to actuate the signal counter 66. A selector 88 is provided for the pump failure detector 84. It may be desired to permanently shut down the well if it does not begin pumping immediately after being restarted. However, in other instances it may be desired to wait until it has failed twice or three times to begin pumping after restart before it is shut down permanently by the pump failure detector and counter 84. This may be adjusted by the selector 88.

The lamp 86 may be supplemented by audible or remote alarm if desired.

Although the details of the different circuits of the different elements of equipment have not been shown those with ordinary skill in the electronic arts will understand how to construct each of the elements and also to connect them together as shown schematically in the drawings. Of course, others skilled in the art may desire to connect them together in certain manners other than as shown in the drawing.

The embodiment shown and described above is only exemplary. We do not claim to have invented all the parts, elements or steps described. Various modifications can be made in the construction, material, arrangement, and operation, and still be within the scope of our invention. The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

10 casing
12 oil producing strata
14 tubing
16 pump
18 bottom hole valve
20 sucker rod
22 traveling valve
24 pump jack
26 walking beam
28 crank
30 electric motor
32 Sampson post
34 production pipe
36 production valve
38 transducer
40 preamplifier
42 filter
44 frequency adjustment
46 gain adjustment
48 phone jack
50 Schmitt trigger
52 pump off timer
54 output jack
56 indicator lamp
58 cycle switch
60 pulse shaper
62 output jack
64 indicator lamp
66 successive missing signal counter
68 indicator lamp
70 timing adjustment
72 pump controller
74 indicator lamp
76 indicator lamp
78 selector
80 time out timer
82 time selector
84 pump failure filter & counter
86 indicator lamp
88 selector

We claim as our invention:

1. The method of determining pump off and pump failure of an oil well having a. a pump jack cyclically reciprocating
b. a sucker rod connected to
c. a traveling valve below the surface of the earth with
d. a bottom hole valve below the traveling valve,
e. said valves producing sonic clicks when operating; comprising the steps of
f. producing an electrical click signal above ground responsive to the clicks of the valve,
g. establishing a critical portion of each cycle of sucker rod reciprocation, and
h. determining if the click signals are in the critical portion.

2. The invention as defined in claim 1 further comprising:

j. counting the number of consecutive cycles wherein the click signals are not received in the critical portion, and
k. shutting down the pump jack when a predetermined number of such cycles have been counted.

3. The invention as defined in claim 2 further comprising:

m. starting the pump a selected time after it has been shut down, and n. immediately shutting the pump jack down again if the click signals are not received during the critical portion.

4. The invention as defined in claim 3 further comprising:

o. counting the number of times the pump jack is immediately shut down, and p. placing the pump jack in a pump failure condition after a pre-selected number of immediate shutdowns have occurred.

5. On an oil well having a. a pump jack cyclically reciprocating b. a sucker rod connected to c. a traveling valve below the surface of the earth with d. a bottom hole valve below the traveling valve, e. said valves producing sonic clicks when operating; the improved structure for determining pump off and pump failure comprising:

f. transducer means attached to the above ground well equipment for producing electrical click signals responsive to the sonic clicks, g. switch means attached to the above ground well equipment for producing electrical cycle signals at a certain point of each cycles of sucker rod reciprocation, h. timer means electrically connected to the switch means for producing a time gate starting with the cycle signals, j. missing signal means connected to the timer means and transducer means for determining if the click signals occurred during the time gate.

6. The invention as defined in claim 5 further comprising:

k. cycle counter means electrically connected to said missing signal means for counting the number of cycles wherein it was determined the click signals did not occur during the time gate, and m. control means for shutting down the pump jack responsive to said cycle counter means.

7. The invention as defined in claim 6 further comprising:

n. a restart means for restarting the pump jack a predetermined time after it has been shut down, and o. failure detection means for detecting if the pump jack is immediately shut down after being restarted.

8. The invention as defined in claim 7 further comprising:

p. failure shut down means for inactivating said restart means responsive to a predetermined number of actuations of said failure detections by said failure detector means.

9. The invention as defined in claim 6 wherein n. said cycle counter means counts the successive cycles wherein no signal occurs.

10. The invention as defined in claim 9 further comprising:

o. a restart means for restarting the pump jack a predetermined time after it has been shut down, and p. failure detection means for detecting if the pump jack is immediately shut down after being restarted.

11. The invention as defined in claim 10 further comprising:

q. failure shut down means for inactivating said restart means responsive to a predetermined number of actuations of said failure detections by said failure detector means.

* * * * *